US006172649B1

(12) United States Patent
Lenormand et al.

(10) Patent No.: US 6,172,649 B1
(45) Date of Patent: Jan. 9, 2001

(54) ANTENNA WITH HIGH SCANNING CAPACITY

(75) Inventors: Régis Lenormand, Blagnac; Frédéric Croq, Tournefeuille; Frédéric Magnin, Toulouse; Philippe Voisin, Tournefeuille, all of (FR)

(73) Assignee: Alcatel, Paris (FR)

( * ) Notice: Under 35 U.S.C. 154(b), the term of this patent shall be extended for 0 days.

(21) Appl. No.: 09/424,901

(22) PCT Filed: Jun. 25, 1998

(86) PCT No.: PCT/FR98/01345

§ 371 Date: Dec. 1, 1999

§ 102(e) Date: Dec. 1, 1999

(87) PCT Pub. No.: WO99/00870

PCT Pub. Date: Jan. 7, 1999

(30) Foreign Application Priority Data

Jun. 26, 1997 (FR) ..... 97 08011

(51) Int. Cl.[7] ..... H01Q 19/19

(52) U.S. Cl. ..... 343/781 P; 343/781 CA; 343/840

(58) Field of Search ..... 343/754, 781 P, 343/781 CA, 840, 837; H01Q 19/19

(56) References Cited

U.S. PATENT DOCUMENTS

| | | | | |
|---|---|---|---|---|
| 3,914,768 | | 10/1975 | Ohm | 343/779 |
| 4,203,105 | * | 5/1980 | Dragone et al. | 343/781 P |
| 4,236,161 | | 11/1980 | Ohm | 343/781 CA |
| 4,595,929 | | 6/1986 | Kreutel, Jr. | 343/781 P |
| 4,755,826 | | 7/1988 | Rao | 343/781 P |
| 5,576,721 | * | 11/1996 | Hwang et al. | 343/753 |
| 5,621,415 | | 4/1997 | Tuck | 342/354 |
| 5,790,077 | * | 8/1998 | Luh et al. | 343/781 P |

OTHER PUBLICATIONS

R. Lenormand et al, "Large Angular Electronic Beam Steering Antenna for Space Application", Proceedings Of The Antennas And Propagation Society International Symposium (APSIS), Chicago, Jul. 20–24, 1992, vol. 1, Jul. 20, 1992, Institute of Electrical and Electronics Engineers, pp. 2–4, XP000342297.

* cited by examiner

*Primary Examiner*—Don Wong
*Assistant Examiner*—Shih-Chao Chen
(74) *Attorney, Agent, or Firm*—Sughrue, Mion, Zinn, Macpeak & Seas, PLLC

(57) ABSTRACT

The invention concerns an antenna with high scanning capacity. The antenna comprises a panel (30) of static radiating elements which are controlled to transmit in variable directions relative to a direction (38) perpendicular to the plane of the panel. Reflectors (34, 44) amplify the scanning effected by the panel (30) of radiating elements. The reflectors (34, 44) are segments of paraboloids with the same axis (38) and the same focus (40), for example.

11 Claims, 3 Drawing Sheets

ANTENNA WITH HIGH SCANNING CAPACITY

BACKGROUND OF THE INVENTION

The present invention relates to an antenna with high scanning capacity. It relates more particularly to an antenna for use in a telecommunications system, in particular a telecommunications system using satellites.

Antennas are frequently needed, in various applications, to receive signals from a mobile source and/or to transmit signals to a mobile receiver or target. Such transmit and/or receive antennas are usually active antennas made up of stationary radiating elements in which the direction of the radiation pattern can be varied by varying the phase of the signals feeding the radiating elements.

That technique cannot produce satisfactory radiation patterns for large squint angles, i.e. for directions departing significantly from the mean transmit and/or receive direction.

A source or a receiver can also be tracked using a conventional antenna moved by a motor. That type of antenna with mechanically movable elements and a motor is not suitable for all applications. In particular, it is preferable to avoid the use of any such antenna in space applications, for reasons of reliability, overall size, and weight.

The invention remedies those drawbacks. It provides an antenna with a high scanning capacity and with a satisfactory radiation pattern at large squint angles, and which does not require any moving parts.

The antenna of the invention comprises a set of static radiating elements commanded to perform scanning and reflector means to amplify the scanning angle of the radiating elements. The reflector means include two reflectors having a common focus, the first reflector receiving the beam transmitted by the set of radiating elements and the second reflector receiving the beam reflected by the first reflector.

SUMMARY OF THE INVENTION

According to the invention, the focal length of the first reflector is greater than the focal length of the second reflector so that the exit beam of the antenna has an inclination to a predetermined direction which is greater than the inclination $\Theta$ relative to the given direction of the beam transmitted by the radiating elements.

The scanning angle of the radiating elements can therefore be reduced in proportion to the amplification provided by the reflector means. Thus the radiating elements are not used for squint angles that are too large. Also, the constraints imposed on radiating elements to scan a small angle are much less severe. In particular, the dimensions of the system are less restricted, which enables a sufficiently large pitch (distance between two adjacent radiating elements) to prevent array lobes without compromising the propagation of the radiation.

The reflector means are in fact analogous to those usually employed to increase the size of the beam, for example in Cassegrain antennas. However, with the invention, the reflector means are used in the opposite way to usual. In a Cassegrain antenna, an increase in the size of the beam corresponds to a reduction in the scanning angle.

In one embodiment of the invention, each reflector is a paraboloid, for example. The scanning amplification gain depends on the ratio between the focal lengths of the two reflectors.

This ratio is 4/1, for example.

The reflectors are disposed so that the output beam is not even partly masked by the first reflector, i.e. the reflector receives the beam from the radiating elements directly.

A preferred application of the invention relates to an antenna for communicating with a plurality of sources or receivers in an extended area, communication having to remain confined within the area despite the changing position of the antenna relative to the area.

This problem arises in particular in a telecommunications system using a network of satellites in low Earth orbit. A system of this kind has already been proposed for high bit rate communication between terrestrial mobile or fixed stations in a particular geographical area covering several hundred kilometers. The altitude of the satellites is in the range from 1000 km to 1500 km.

In the above system, each satellite includes groups of transmit and receive antennas and each group is dedicated to a given area. The receive antennas in each group receive signals from a station in the area and the transmit antennas retransmit the received signals to another station in the same area. The antennas of a particular group point towards the area for all the time it remains within the field of view of the satellite. Accordingly, for each satellite, a region of the Earth is divided into n areas, and as the satellite moves over a region, each area is allocated a group of transmit and receive antennas which point towards it continuously.

While the satellite is moved over a region, which takes around twenty minutes, for example, assigning a single group of transmit and receive antennas to an area avoids switching between antennas, which could compromise the speed or quality of communication.

The low altitude of the satellites also minimizes propagation times, which is beneficial for interactive communications, in particular in multimedia applications.

Clearly, with the above telecommunications system it is preferable for an antenna intended for one area not to suffer from interference due to signals from other areas and for it not to interfere with other areas. Also, the radiation pattern has a shape which varies with the position of the satellite relative to the area. When the areas on the Earth are all circular, the antenna sees the area in the form of a circle when the satellite is at the nadir of the area; in contrast, as the satellite moves away from this position the antenna sees the area in the form of an ellipse that is progressively flattened as the satellite approaches the horizon.

BRIEF DESCRIPTION OF THE DRAWING

It has been found that an antenna in accordance with the invention in which the reflectors are paraboloids can match the trace of the pattern on the ground to the position of the antenna relative to the area without it being necessary to modify the radiation pattern produced by the radiating elements.

Also, the antenna has a high gain when the satellite is close to the horizon relative to the area. This is when the distance from the satellite to the area is the greatest; accordingly, the increasing gain compensates for the increase in the distance, which is favorable to maintaining calls.

In one embodiment, two antennas of the above type are used to track an area, each antenna effecting an even smaller scan.

An antenna of the invention can be used to track more than one area, the radiating elements being able to receive signals from or send signals to more than one area.

DETAILED DESCRIPTION OF THE INVENTION

Figure 1:
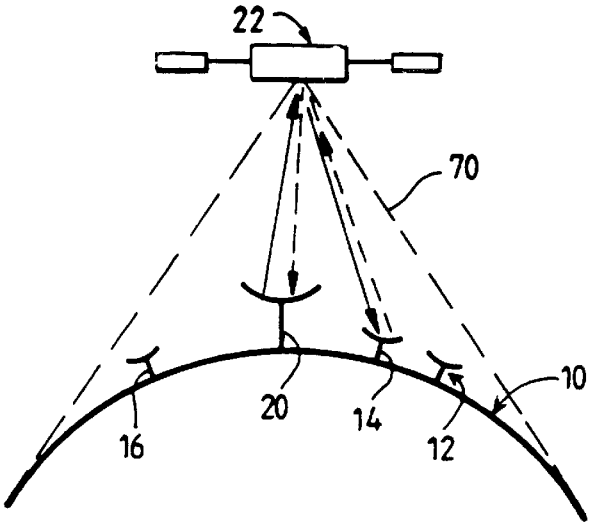
Figure 2:
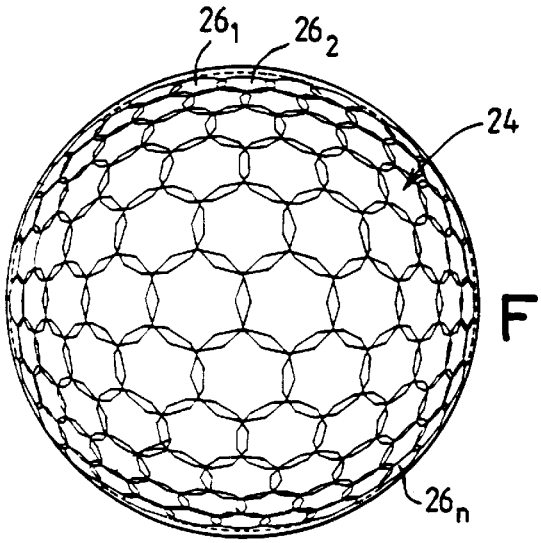
Figure 3:
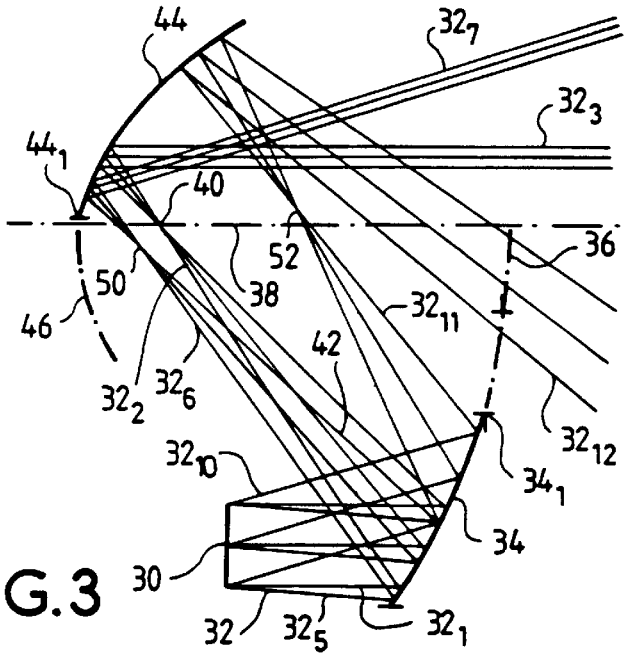
Figure 4:
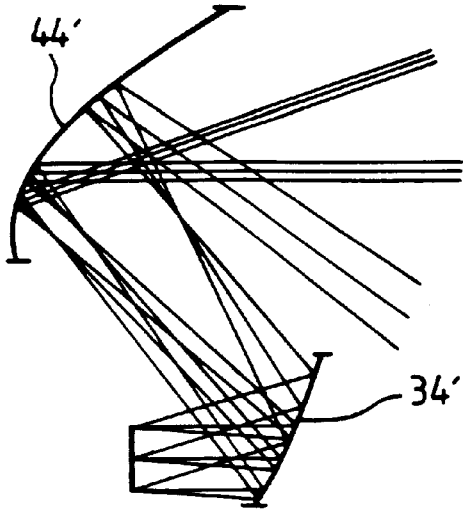
Figure 5:
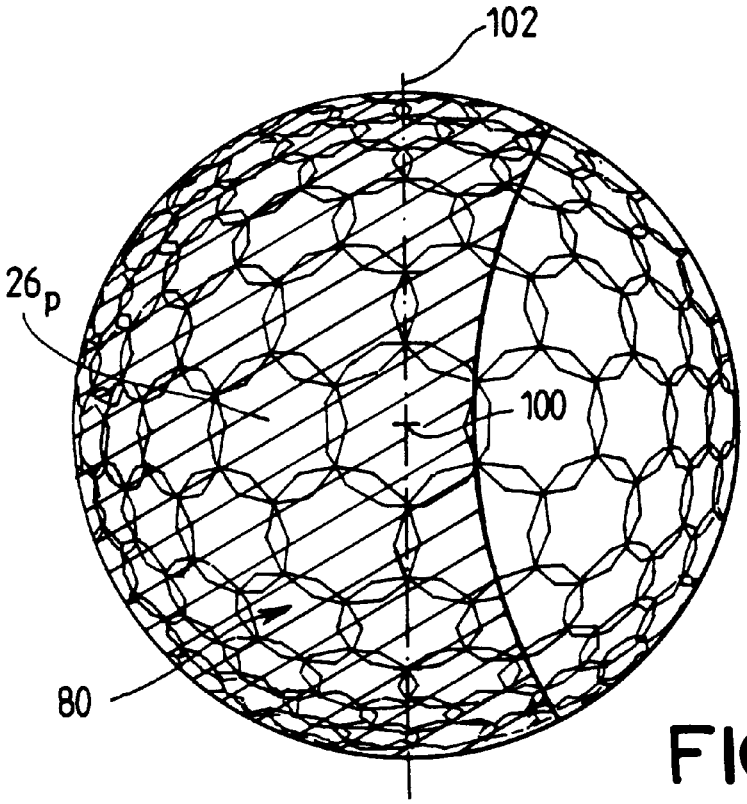
Figure 6:
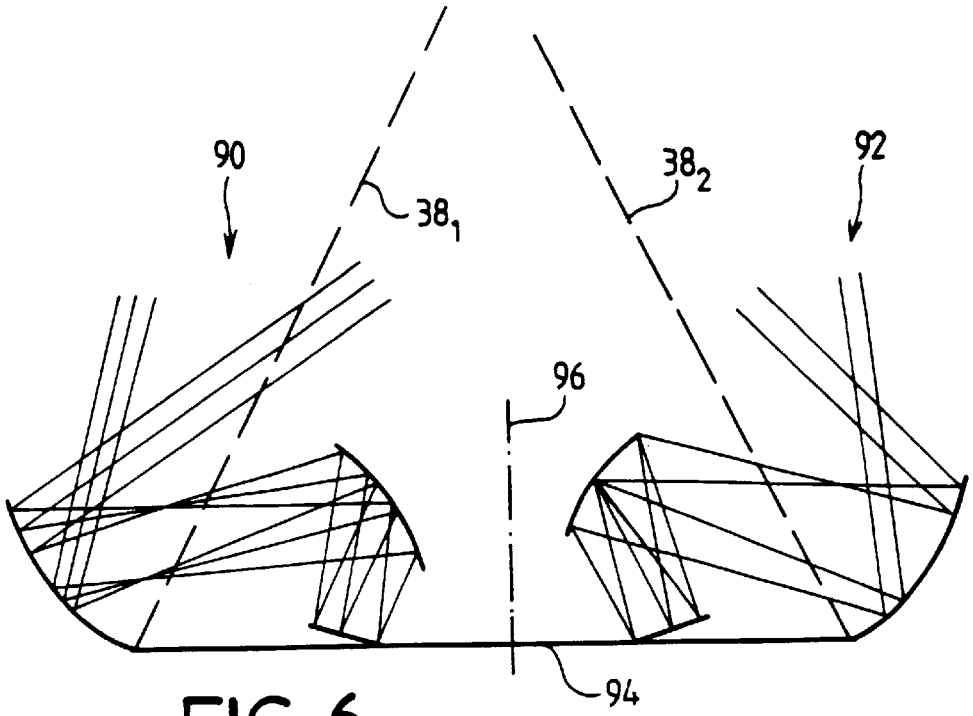
Figure 7:
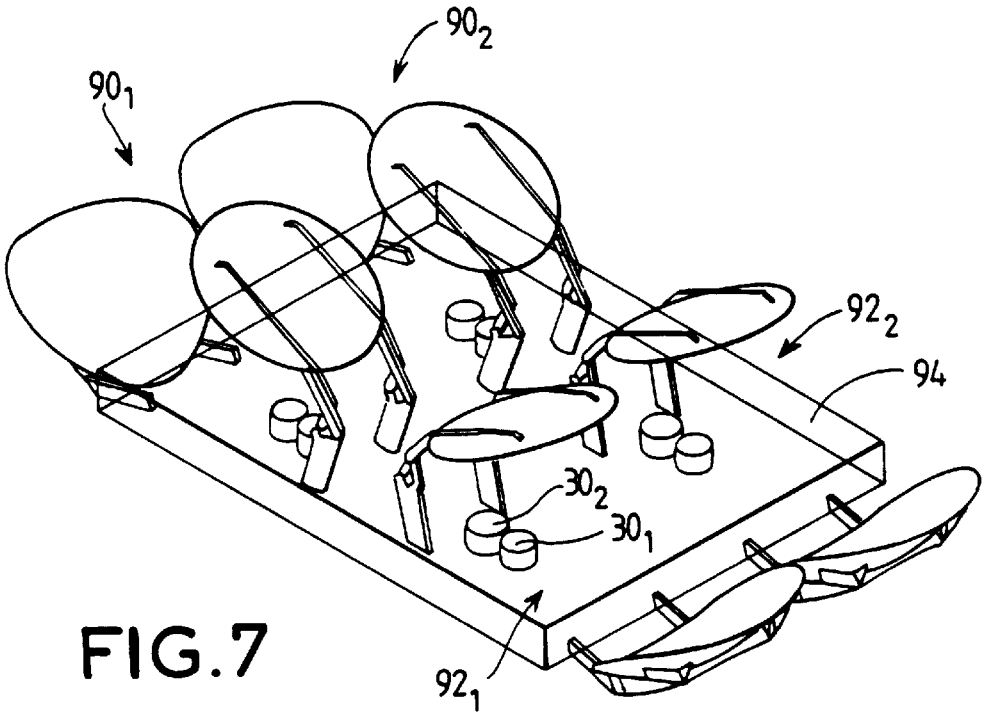

Other features and advantages of the invention become apparent from the following description of embodiments of the invention given with reference to the accompanying drawings, in which:

FIG. 1 is a diagram showing a telecommunications system linking terrestrial mobile or fixed stations using a system of satellites;

FIG. 2 is a diagram showing a telecommunications system;

FIG. 3 is a sectional diagram of an antenna of the invention;

FIG. 4 is a sectional diagram of a variant antenna;

FIG. 5 is a diagram showing the region that the antenna shown in FIG. 4 can cover;

FIG. 6 is a diagram showing two associated antennas covering all the areas shown in FIG. 6; and FIG. 7 is a perspective diagram of an embodiment using associated antennas.

The example of an antenna to be described is intended for a telecommunications system using a constellation of satellites in low Earth orbit, approximately 1300 km above the surface 10 of the Earth.

The system must set up calls between users 12, 14, 16 and one or more connection stations 20 to which service providers such as databases are connected (see FIG. 1). Calls between users are also set up via the connection station 20.

These calls employ a satellite 22.

In the system, the satellite 22 can see a region 24 of the Earth at all times and this region is divided into areas $\mathbf{26}_1$, $\mathbf{26}_2$, . . . , $\mathbf{26}_n$ (see FIG. 2).

Each area $\mathbf{26}_i$ is in the form of a circle having a diameter of approximately 700 km. Each region 24 is defined by a cone 70 centered on the satellite and having a cone angle determined by the altitude of the satellite (see FIG. 1). A region is therefore that part of the Earth which is visible from the satellite. When the altitude of the satellite is 1300 km, the cone angle is approximately 110°.

Terrestrial means are used for communication between areas, for example cables between the connecting stations of the various areas that are part of the same region or different regions.

The number and the disposition of the satellites are such that at any time two or three satellites can be seen from an area $\mathbf{26}_i$. When an area $\mathbf{26}_i$ leaves the field of view of the satellite assigned to calls in that area, there is therefore another satellite ready to take over, and switching from one satellite to the other is instantaneous.

However, such switching occurs only about once every twenty minutes. In practice this switching occurs when, for the area $\mathbf{26}_i$ in question, the elevation of the satellite drops below 20°.

As the satellite crosses a region 24, the antennas of the invention always point towards the same area or the same set of areas. They must therefore have a high capacity for scanning or squinting.

To this end, as shown in FIG. 3, the antenna comprises a panel 30 of radiating elements associated with a beam-forming network (not shown) controlling the phase of the signals feeding the radiating elements. A beam 32 transmitted by the panel 30 is directed towards a first reflector 34 having the form of a paraboloid with a circular cut-off. The reflector is part of an imaginary surface 36 whose axis 38, on which the focus 40 lies, is far away from the reflector 34.

The axis 38 is perpendicular to the plane of the panel 30.

The reflector 34 reflects the beam 42 towards a second reflector 44 on the side of the axis 38 opposite to the reflector 34 and the panel 30. The reflector 44 is also part of an imaginary surface 46 in the plane of FIG. 3, which is a parabola with the same focus 40 and the same axis 38 as the parabola 36. The surface 46 is also a paraboloid.

The concave side of the reflector 44 faces towards the concave side of the reflector 34.

The focal length of the reflector 44 is one quarter that of the reflector 34, for example.

The axis 38 does not intersect the reflector 34 or 44. The edge $\mathbf{44}_1$ of the reflector 44 nearest the axis 38 is at a distance from that axis substantially less than the distance from the corresponding edge $\mathbf{34}_1$ of the reflector 34 to the axis 38.

In the example shown in FIG. 3 the array 30 has a generally circular exterior shape with a diameter of approximately 30 cm (12λ) with 37 radiating elements separated from each other by 42 mm (1.7λ), where λ is the wavelength of the radiation.

Each of the reflectors has a circular cut-off. In this example, the diameter of the circle defining the reflector 34 is in the order of 28λ. The diameter of the circle defining the reflector 44 is in the order of 30λ. The distance between the edge $\mathbf{34}_1$ and the axis 38 is 24λ and the distance between the edge $\mathbf{44}_1$ of the reflector 44 and the axis 38 is 4'.

When the array 30 transmits a beam $\mathbf{32}_1$ parallel to the axis 38, i.e. perpendicular to its plane, the beam reflected by the reflector 34 is focused at the focus 40. The reflector 44 therefore reflects the beam $\mathbf{32}_2$ parallel to the axis 38, as represented by the beam $\mathbf{32}_3$.

If the array 30 transmits a beam $\mathbf{32}_1$ inclined at a relatively small angle Θ to the axis 38, the beam $\mathbf{32}_6$ reflected by the reflector 34 converges at a point 50 near the focus 40, and the beam $\mathbf{32}_7$ reflected by the reflector 44 is inclined at an angle which is approximately n times the angle Θ, n being the ratio of the focal length f of the reflector 34 to the focal length f' of the reflector 44. In the example, the ratio between the focal lengths being 4/1, the beam $\mathbf{32}_7$ is inclined at an angle of 4Θ to the axis 38.

However, this amplification in the ratio of the focal lengths does not occur for beams $\mathbf{32}_{10}$ transmitted by the array 30, which beams have a large angle of inclination to the axis 38.

Accordingly, FIG. 3 shows that the beam $\mathbf{32}_{10}$ is reflected as a beam $\mathbf{32}_{11}$ by the reflector 34 and this beam converges at a point 52 far away from the focus 40. The beam $\mathbf{32}_{11}$ is reflected by the reflector 44 as a beam $\mathbf{32}_{12}$.

For example, for a beam with azimuth $\phi$=90° and inclination Θ of 4.5° to the axis 38, i.e. to the normal to the plane of the array 30, the beam $\mathbf{32}_7$, also with an azimuth of 90°, is inclined at 18° to the axis 38. This value is indeed 4Θ.

On the other hand, for an inclination, or squint, of −14° (beam $\mathbf{32}_{10}$), again with an azimuth of 90°, the beam $\mathbf{32}_{12}$ has an inclination of 38° to the axis 38, which is significantly less than four times the inclination of the beam $\mathbf{32}_{10}$. The azimuth of the beam $\mathbf{32}_{12}$ is also 90°.

In the example, for an azimuth of 90°, the beam transmitted by the array 30 can scan an angle Θ in the range from 4.5° to −14°. These limits are imposed, in the first instance, by geometry because the beam reflected by the reflector 34 must reach the reflector 44 and the beam reflected by the reflector 44 must not be masked by the reflector 34. Secondly, the radiation performance of the beams converging in front of the focus 40 (in the direction of the exit beam) also limits the scan angle because, for these inclined beams, operation is far from nominal.

FIG. 4 relates to a variant of FIG. 3 in which the reflector 44' is generally oval in shape, i.e. longer in one direction than in the orthogonal direction, and the reflector 34' has a circular cut-off, like the reflector 34.

The greatest dimension of the reflector 44' is in the plane of symmetry perpendicular to the axis 38 common to the two paraboloids. In this example, this greatest dimension is approximately 48λ.

The other features are the same as in FIG. 3.

The geometry shown in FIG. 4 yields the same performance for an azimuth of 90° as the antenna shown in FIG. 3.

For a beam transmitted by the array 30 with an azimuth of 0°, and for an inclination Θ of −5° to the axis 38, the exit beam is inclined at −20° with an azimuth of 2.3°. For a squint Θ of −15° and an azimuth of 0°, the squint of the exit beam is −45° with an azimuth angle of 31.5°.

With this reflector, and for an azimuth of 90°, the squint of the beam transmitted by the array 30 can be varied in the range from +4° to −14° in the plane containing the center of the array 30 and the axis 38 and in the range from +15° to −15° in the plane of symmetry.

With these squint angles the antenna cannot cover all of the region seen by the satellite but only the portion 80 of that region which is shaded in FIG. 5. The portion 80 represents approximately 60% of the region.

To be able to cover all of the region, a pair of antennas arranged as shown in FIG. 6 is used. In this example, one antenna 90 transmits more towards the West and one antenna 92 transmits more towards the East.

The two antennas 90 and 92 are fastened to a plane support 94 whose normal 96 is directed towards the center of the Earth. In other words, the axis 96 always points towards the point 100 in FIG. 5.

The antennas 90 and 92 transmit towards regions which are symmetrical about the axis 102 (FIG. 5). Thus the antenna 90 transmits towards the region 80 and the antenna 92 transmits towards the region symmetrical to the region 80 about the axis 102. The axis $\mathbf{38}_1$ of the antenna 90 is inclined to the axis 96 so that it is directed towards an area 26*p* corresponding substantially to the center of the region 80 (see FIG. 5). The axis $\mathbf{38}_2$ of the antenna 92 is of course inclined symmetrically.

It should be noted that the same array of radiating elements 30 can be used to transmit a plurality of beams. In other words, the same array 30 associated with the reflectors 34 and 44 or 34' and 44' can be used to transmit towards more than one area or to receive signals from more than one area.

In the example shown in FIG. 7 a common support 94 carries two pairs of antennas $\mathbf{90}_1$, $\mathbf{92}_1$ and $\mathbf{90}_2$, $\mathbf{92}_2$. Each antenna, for example the antenna $\mathbf{92}_1$, comprises two panels of radiating elements, a transmit panel $\mathbf{30}_1$ and a receive panel $\mathbf{30}_2$.

It can be seen that in all the embodiments the gain is greater at the limit of the region 24 than at the nadir. The limits of the region correspond to the greatest inclinations, for which the area concerned of the exit reflector (radiating aperture) is greatest and therefore for which the resolution is the highest. This property is apparent in FIG. 3 where it can be seen that the reflector 44 of the beam $\mathbf{32}_{12}$ corresponds to a larger area than the beam $\mathbf{32}_3$. In this way, for the areas with the greatest inclination, i.e. those at the greatest distance, the increase in the gain compensates for the increase in the distance.

It has also been found that the shape of the trace on the ground matches the target area.

What is claimed is:

1. An antenna comprising a set (30; $\mathbf{30}_1$, $\mathbf{30}_2$) of static radiating elements commanded to transmit a beam in variable directions relative to a given central direction and reflector means (34, 44; 34', 44') including two reflectors (34, 44; 34', 44') having a common focus (40), the first reflector (34, 34') receiving the beam transmitted by the set of radiating elements and the second reflector (44; 44') receiving the beam reflected by the first reflector, characterized in that the focal length of the first reflector (34, 34') is greater than the focal length of the second reflector (44', 44') so that the exit beam of the antenna has an inclination to a predetermined direction (38) which is greater than the inclination Θ relative to the given direction (38) of the beam transmitted by the radiating elements (30).

2. An antenna according to claim 1, characterized in that each of the reflectors (34, 44; 34', 44') is a segment of a paraboloid.

3. An antenna according to claim 1, characterized in that the two reflectors have a common axis (38).

4. An antenna according to claim 3, characterized in that the common axis (38) is in the central direction.

5. An antenna according to any of claim 1, characterized in that at least one reflector is defined by a substantially circular edge or cut-off.

6. An antenna according to claim 1, characterized in that at least one reflector is defined by an elongate edge or cut-off.

7. An antenna according to claim 1, characterized in that the set (30) of radiating elements is commanded to radiate simultaneously towards a plurality of separate areas ($\mathbf{26}_1$, $\mathbf{26}_2$, . . . ).

8. An antenna according to claim 1, characterized in that it is oriented so that the radiating aperture is larger for pointing directions corresponding to targets (26) at the greatest distances than for nearer targets.

9. An antenna according to claim 1, characterized in that it includes a set of transmit radiating elements ($\mathbf{30}_1$) and a set of receive radiating elements ($\mathbf{30}_2$) which are associated with the same reflector means.

10. A set of at least two antennas each of which is an antenna according to any preceding claim, characterized in that the radiating elements and the reflector means of both antennas are symmetrical about an axis (96) constituting a central aiming axis of the antenna.

11. The use of an antenna according to any preceding claim to a telecommunications system using non-geostationary satellites, the antenna, mounted on a satellite, being commanded so that it always views the same area ($\mathbf{26}_i$) as the satellite moves over a region (24) divided into a plurality of areas of substantially the same shape and size.

* * * * *